United States Patent [19]

Montalvo

[11] 4,358,142

[45] Nov. 9, 1982

[54] CAN CRUSHING DEVICE

[76] Inventor: Arthur A. Montalvo, 1505 N. Franklin Pl., Apt. 305, Milwaukee, Wis. 53202

[21] Appl. No.: 236,219

[22] Filed: Feb. 19, 1981

[51] Int. Cl.[3] ..... A47F 13/06

[52] U.S. Cl. ..... 294/19 R

[58] Field of Search ..... 294/19 R, 1 R, 8.5, 294/11, 22, 61, 23, 50.8, 50.9, 104, 115

[56] References Cited

U.S. PATENT DOCUMENTS 3,105,715 10/1963 Happ ..... 294/19 R

*Primary Examiner*—James B. Marbert

*Attorney, Agent, or Firm*—Andrus, Sceales, Starke & Sawall

[57] ABSTRACT

A hand held device for manually crushing disposable beverage cans includes a crushing member having an approximate length at least equal to the diameter of the can and a width less than the length of the can. A connecting member joins the crushing member to a handle. The shape and size of the crushing member result in deformation of substantially the entire sidewall of the can upon forceful engagement of the crushing member with the sidewall without the can clinging or adhering to the crushing member.

1 Claim, 3 Drawing Figures

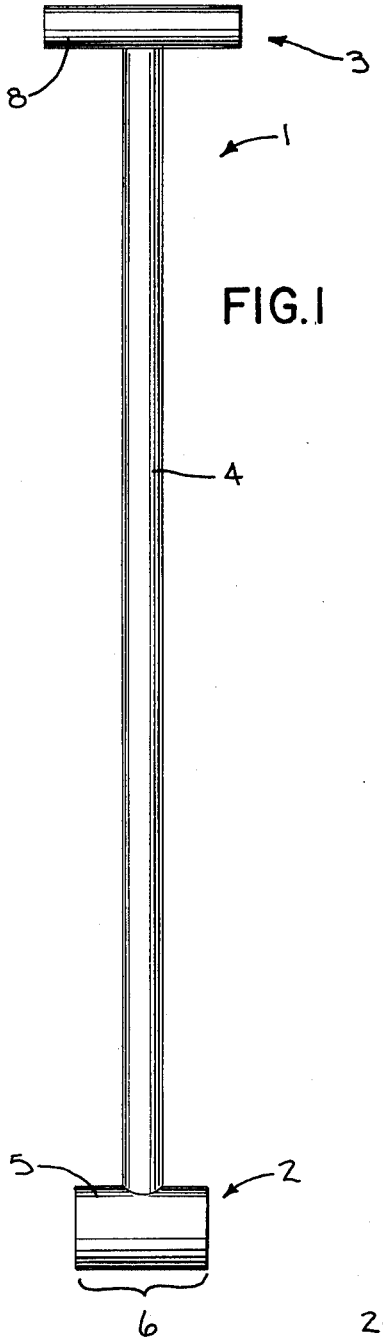
FIG.1
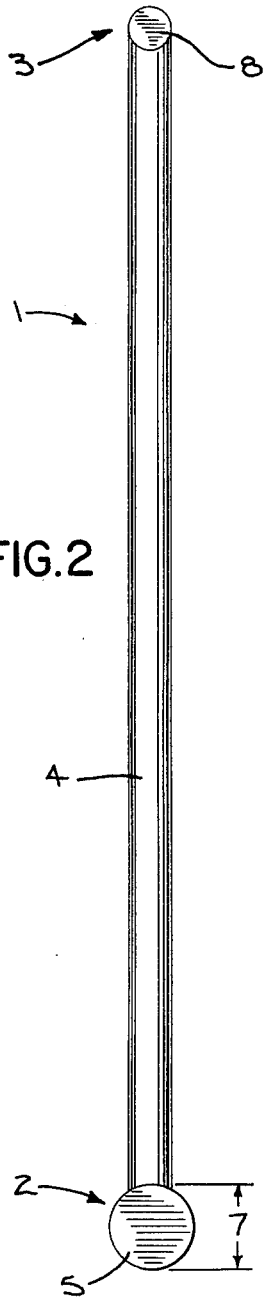
FIG.2
FIG.3
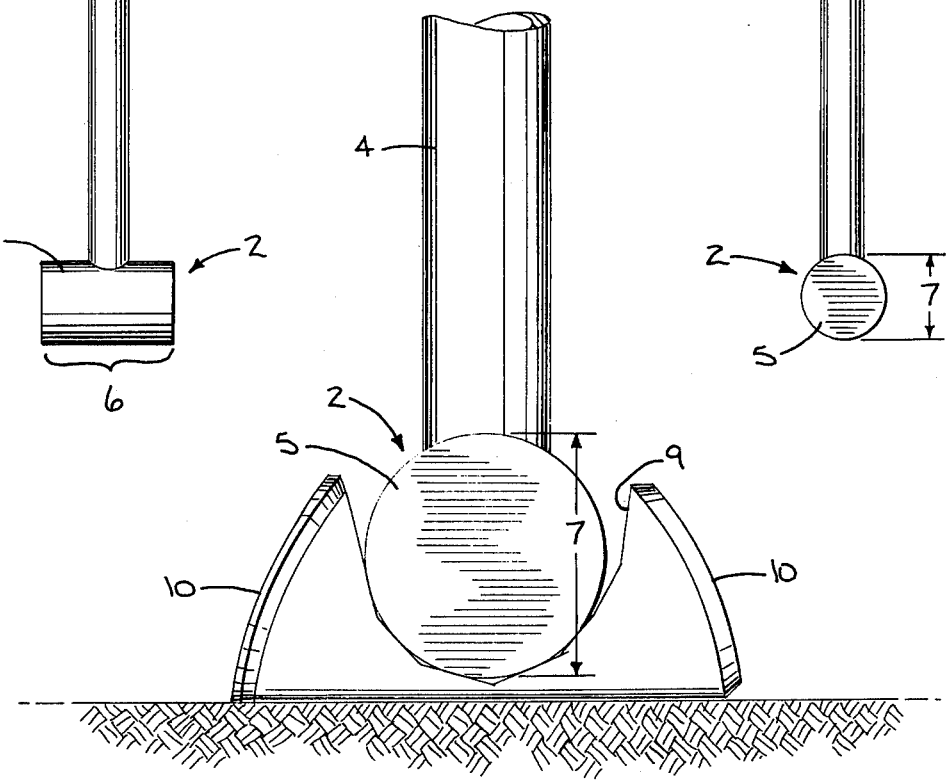

CAN CRUSHING DEVICE

BACKGROUND OF THE INVENTION

The recycling of disposable aluminum beverage cans has become a matter of concern and interest to not only the can industry and protectors of the ecology but also to groups, organizations and even individuals who have come to realize the fund raising or income supplementing potential of collecting and recycling aluminum cans.

The main drawback an individual faces in collecting a meaningful number of cans is that, due to their size and shape, the cans quickly fill a collecting bag such as a plastic garbage bag. Therefore, a device for crushing the cans would facilitate and encourage collecting and recycling.

In the past can crushers have consisted of elaborate machines that were costly to manufacture in that they usually involved hydraulically or pneumatically actuated moving parts. Such devices were also too heavy or bulky to be hand held and carried with an individual as he collected discarded cans.

SUMMARY OF THE INVENTION

The present invention relates to can crushing devices and more particularly to hand held devices for manually crushing disposable beverage cans and more particularly aluminum beverage cans measuring approximately 5 inches in length by 2½ inches in width.

The can crushing device includes a crushing member having an approximate length at least equal to the diameter of the can and a width less than the length of the can.

A connecting member joins the crushing member to a handle.

The size and shape of the crushing member result in deformation of substantially the entire sidewall of the can upon forceful engagement of the crushing member with the sidewall and yet the size and shape of the crushing member also allows the crushing member to be withdrawn from the crushed sidewall without the can clinging or adhering to the crushing member.

The present invention thus provides a hand held can crusher that is devoid of moving parts and as such may be inexpensively manufactured.

The size, shape and ease of use of the device facilitate can crushing and as such encourage the collecting and recycling of discarded aluminum beverage cans.

BRIEF DESCRIPTION OF THE DRAWINGS

The drawings illustrate the best mode presently contemplated of carrying out the invention.

In the drawings:

FIG. 1 is a side view of the can crushing device of the present invention;

FIG. 2 is an end view of the can crushing device of FIG. 1; and

FIG. 3 is an enlarged end view of the crushing member of the can crushing device as it is applied to the sidewall of a can.

DETAILED DESCRIPTION OF THE PREFERRED EMBODIMENT

A hand held can crushing device 1 consists of a can crushing member 2 connected to a handle 3 by means of an elongated connecting member 4.

The crushing member 2 consists of a steel cylinder 5 having an approximate length 6 at least equal to and preferably longer than the diameter of the beverage can to be crushed. Cylinder 5 also has a width or diameter 7 less than the length of the can.

While applicant envisions a variety of shapes for crushing member 2 e.g. square, triangular, etc., it has been found that the cylindrical shape facilitates manufacture and reduces the cost. It has also been found that crushing member 2 best serves its function when it is approximately 4 inches long and has a diameter of approximately 2½ inches.

The handle 3 also consists of a cylinder 8. While the dimensions of cylinder 8 are not critical, it has been found that a diameter of 1¼ inches and a length of 6 inches provide a handle that is both comfortable to use and easy to control. The longitudinal axis of cylinder 8 is also in the same plane as the longitudinal axis of cylinder 5. Such an arrangement facilitates the positioning of crushing member 2 prior to engagement with the sidewall 9 of can 10.

Connecting member 4 joins crushing member 2 and handle 3 at the approximate centers of their longitudinal axes. This arrangement allows maximum crushing force to be transferred from the operator to the can sidewall with a minimum amount of effort by the operator. While connecting member 4 may be of any suitable length, it has been found that a length of approximately 34 inches is most comfortable and convenient for the user of the device.

The operation of the can crushing device is shown in FIG. 3. Crushing member 2 is forcefully abutted against the sidewall 9 of can 10 which is lying with its longitudinal axis parallel to the ground. Due to the shape and size of crushing member 2 substantially the entire sidewall 9 of can 10 is deformed and yet the ends of can 10 do not buckle to the point where they engage crushing member 2 and cling to crushing member 2 as it is withdrawn from sidewall 9. Once crushing member 2 has been withdrawn from the deformed sidewall, the operator may then apply his foot to the can which will collapse readily to a flattened state. If the operator prefers not to use his foot, he may rotate crushing device 1 90° and strike the can once more. This permits a large number of cans to be quickly and efficiently crushed, thus facilitating and encouraging the collection and recycling of disposable aluminum cans.

Various modes of carrying out the invention are contemplated as being within the scope of the following claims, particularly pointing out and distinctly claiming the subject matter which is regarded as the invention.

I claim:

1. A hand held device for manually crushing disposable beverage cans comprising:

a generally cylindrical handle member, a generally cylindrical crushing member for engagement with the sidewall of the can, said crushing member having an approximate longitudinal axis at least equal to the diameter of the can and a diameter less than the longitudinal axis of the can whereby upon impact with the can substantially the entire sidewall of the can is deformed and whereby the crushing member may be withdrawn from said deformed can with said deformed can remaining in its resting place, and an elongated connecting member joining the approximate center of the longitudinal axis of said handle to the approximate center of the longitudinal axis of said crushing member, the longitudinal axes of said handle and said crushing member being in the same plane and substantially perpendicular to the longitudinal axis of said connecting member.

* * * * *